US009540921B2

(12) United States Patent
Al-Ajaji et al.

(10) Patent No.: US 9,540,921 B2
(45) Date of Patent: Jan. 10, 2017

(54) DUAL PURPOSE OBSERVATION AND PRODUCTION WELL

(75) Inventors: Abdulaziz A. Al-Ajaji, Khobar (SA); Fahad A. Al-Ajmi, Doha (SA); Mohammad S. Kanfar, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 636 days.

(21) Appl. No.: 13/236,816

(22) Filed: Sep. 20, 2011

(65) Prior Publication Data

US 2013/0068453 A1 Mar. 21, 2013

(51) Int. Cl.

| | |
|---|---|
| ***E21B 41/00*** | (2006.01) |
| ***E21B 47/01*** | (2012.01) |
| ***E21B 47/12*** | (2012.01) |
| ***E21B 33/124*** | (2006.01) |
| *E21B 43/00* | (2006.01) |
| *E21B 47/06* | (2012.01) |

(52) U.S. Cl.

CPC ..... *E21B 47/01* (2013.01); *E21B 33/124* (2013.01); *E21B 41/0035* (2013.01); *E21B 47/12* (2013.01); *E21B 43/00* (2013.01); *E21B 47/06* (2013.01)

(58) Field of Classification Search

CPC ..... E21B 47/001; E21B 47/12; E21B 47/01; E21B 41/0035; E21B 33/124; E21B 33/122; E21B 43/00; E21B 47/06

USPC ..... 166/254.2, 250.01, 254.1, 191, 250.07

See application file for complete search history.

(56) References Cited

U.S. PATENT DOCUMENTS

| | | | | |
|---|---|---|---|---|
| 3,193,005 | A | 7/1965 | Hunter et al. | |
| 4,807,704 | A | 2/1989 | Hsu et al. | |
| 5,213,159 | A | 5/1993 | Schneider | |
| 5,353,876 | A * | 10/1994 | Curington et al. | 166/313 |
| 6,041,860 | A | 3/2000 | Nazzal et al. | |
| 6,119,780 | A | 9/2000 | Christmas | |
| 6,176,312 | B1 | 1/2001 | Tubel et al. | |

(Continued)

FOREIGN PATENT DOCUMENTS

GB 2365897 A 2/2002

OTHER PUBLICATIONS

PCT Int'l Search Report and the Written Opinion dated Jul. 18, 2013; Int'l Application No. PCT/US2012/056016; Int'l Filing Date: Sep. 19, 2012.

*Primary Examiner* — Nicole Coy
*Assistant Examiner* — Kristyn Hall
(74) *Attorney, Agent, or Firm* — Bracewell LLP; Constance Gall Rhebergen

(57) ABSTRACT

A method for producing hydrocarbons in a subterranean well useful for observing properties of one or more subterranean zones, includes the steps of: (a) installing a lower straddle packer in a vertical well section below a junction with a lateral well section; (b) installing an upper straddle packer in a vertical well section above the junction with the lateral well section; (c) conveying hydrocarbons from the lateral well section to the surface with a tubing; (d) observing pressure information in at least one zone with a pressure gauge located in the vertical well section below the lower straddle packer; and (e) obtaining information in the at least one zone with logging equipment run through the tubing. A sidetrack window may be installed in the tubing between the lower straddle packer and the upper straddle packer for providing access to the lateral well section.

19 Claims, 3 Drawing Sheets

(56) References Cited

U.S. PATENT DOCUMENTS

| | | | | |
|---|---|---|---|---|
| 6,199,633 | B1 * | 3/2001 | Longbottom | 166/242.6 |
| 6,230,800 | B1 | 5/2001 | Bryant | |
| 6,308,782 | B1 | 10/2001 | Brooks et al. | |
| 7,303,009 | B2 | 12/2007 | Al-Muraikhi | |
| 2002/0007970 | A1 * | 1/2002 | Terry et al. | 175/92 |
| 2005/0230121 | A1 * | 10/2005 | Martinez et al. | 166/372 |
| 2008/0223585 | A1 * | 9/2008 | Patel et al. | 166/385 |
| 2008/0302529 | A1 * | 12/2008 | Fowler et al. | 166/250.01 |

* cited by examiner

DUAL PURPOSE OBSERVATION AND PRODUCTION WELL

BACKGROUND OF THE INVENTION

1. Field of the Invention

The present invention relates to subterranean wells for the production of oil and gas or other fluids. More specifically, the invention relates to an apparatus and method for a providing a single well for simultaneously producing and observing.

2. Description of the Related Art

Monitoring pressure and saturation in a producing reservoir is critical for proper reservoir management, and it is being accomplished throughout the industry in a variety of ways. In offshore fields, wells are drilled from expensive platforms with limited number of drilling slots. Therefore, dedicating a slot for observation only instead of production is costly.

A common practice is to drill a vertical well across multiple zones and perforate the target zone for production and pressure monitoring purposes. At the same time, it is possible to intervene rig-less and run saturation logs across all zones or run production logging across the perforated zone. Inconveniently, this practice has several setbacks. For example, continuous pressure measurement is not possible. Producing the well will cause the pressure immediately around the well bore to drop, and therefore the pressure readings will not be representative of the general area around the well. Getting a representative pressure reading requires shutting-in the well for few days until pressure stabilizes. Shutting-in the well will cause losing potential production and thus revenue.

Another disadvantage of current methods is that production and pressure monitoring have to be in the same reservoir. If production from another zone/reservoir is desired, two reservoirs have to be perforated, isolated with straddle packers and completed with duel completion. Doing so will restrict running logs since the reservoirs will be behind both a tubing and a casing string which will hinder logs from reading the formation. In addition, vertical wells have low production rates compared to horizontal producers so it would be advantageous to have a production well that is horizontal.

From the foregoing, a need has arisen to design a method and apparatus that enables continuous pressure measurement, production and pressure monitoring from separate reservoirs, and production from an accessible horizontal lateral.

SUMMARY OF THE INVENTION

Embodiments of the current application provide a method and apparatus for addressing the shortcomings of the current art, as discussed above. The current application discloses a single well able to serve as a horizontal producer and a vertical observation well simultaneously with the luxury of full accessibility to both production and observation regions within the well. In the embodiments of the current invention, the cost of drilling an additional well is eliminated, more drilling slots can be availed for producers rather than observation wells, and more data can be acquired from a single slot. In offshore operations this can amount to significant cost saving.

The invention revolves around drilling one well with two laterals; one vertical for observing a single or multiple reservoirs, and one horizontal for producing. After drilling the vertical observation section, the well will be sidetracked with level-four technology into a selected reservoir providing a producing lateral. The vertical section of the well is maintained for observation purposes and will continuously provide pressure data from one reservoir through perforations. Whenever water saturation profiles are needed across the different reservoirs, the well will be temporarily shut-in and the saturation logs are run across the observation section through a Y-tool. The integrated well design allows full flexibility for intervention in the producing lateral, where coiled tubing can be utilized to stimulate or log the well with a production log tool ("PLT").

Dual purpose wells of the present application will significantly reduce cost and efficiently utilize resources including the costs associated with drilling time and completion. Additionally, they avail more drilling slots to be utilized for drilling producing wells, making them particularly attractive for offshore developments or those with limited drilling slots. In addition to monitoring pressure and saturation, the dual purpose wells of the present application serve as a horizontal producer.

One embodiment of the current application includes a method for producing hydrocarbons in a subterranean well useful for observing properties of one or more subterranean zones, comprises the steps of: (a) installing a lower straddle packer in a vertical well section below a junction with a lateral well section; (b) installing an upper straddle packer in a vertical well section above the junction with the lateral well section; (c) conveying hydrocarbons from the lateral well section to the surface with a tubing; (d) observing pressure information in at least one zone with a pressure gauge located in the vertical well section below the lower straddle packer; and (e) obtaining information in the at least one zone with logging equipment run through the tubing.

In some embodiments, the method also includes installing a sidetrack window in the tubing between the lower straddle packer and the upper straddle packer for providing access to the lateral well section, the tubing sidetrack window having a sliding means for opening and closing access to the tubing sidetrack window. The method may alternatively include opening the sliding means of the tubing sidetrack window, running coiled tubing from the surface down the tubing, through the tubing sidetrack window and into the lateral well section, and performing an intervention procedure on the lateral well section.

In other embodiments, the method includes providing a sliding sleeve opening in the tubing below the upper straddle packer and opening the sliding sleeve opening to allow fluids from the lateral well section to enter the tubing. The method may also include the step of installing an isolation means below the upper straddle packer to prevent fluids below the isolation means within the tubing from flowing towards the surface.

In alternative embodiments, the method might also include installing a y-tool above the upper straddle packer, connecting the tubing to a first lower branch of the y-tool, connecting an electrical submersible pump to a second lower branch of the y-tool, and operating the electrical submersible pump to assist with the production of fluids from the lateral well section. Logging equipment may be run through the first lower branch of the y-tool to bypass the electrical submersible pump.

In yet other alternative embodiments, the method may include providing a means for opening and closing the sidetrack window, opening the tubing sidetrack window, running coiled tubing from the surface down the tubing, through the first lower branch of the y-tool, through tubing sidetrack window and into the lateral well section, and performing an intervention procedure on the lateral well section.

There may be both a production zone and an observation zone and the method may further comprise perforating the vertical well below the lower straddle packer at the level of the observation zone. Pressure information may be obtained with the gauge in the production zone, saturation information may be obtained in both the production and observation zones, and production logs may be obtained in the observation zone.

In other embodiments of the current application, an apparatus for producing hydrocarbons from a subterranean well while observing properties of one or more subterranean zones comprises an upper straddle packer located in a vertical well section above a junction with a producing lateral well section, a lower straddle packer located in the vertical well section below the junction with the lateral well section, a pressure gauge located in a vertical well section below the lower straddle packer and above a perforated zone, a tubing located in the vertical well for conveying hydrocarbons from the lateral well section to the surface and for running tools from the surface through the upper straddle packer, and a means for isolating fluids in the vertical well below the lower straddle packer from fluids in the lateral well section.

In some embodiments, the apparatus further comprises a sidetrack window in the tubing between the lower straddle packer and the upper straddle packer for providing access to the lateral well section, the tubing sidetrack window having a sliding means for opening and closing access to the sidetrack window. In addition, a sliding sleeve opening in the tubing below the upper straddle packer, may be operable such that when the sliding sleeve opening is opened, fluids from the lateral well section may enter the tubing and flow to the surface. The isolation means may be a nipple profile located below the sliding sleeve opening.

In other embodiments, the apparatus may include a y-tool located above the upper straddle packer, the tubing being connected to a first lower branch of the y-tool and an electrical submersible pump connected to a second lower branch of the y-tool to assist with the production of fluids from the lateral well section. The lateral well section may be located in a production zone which is separate from the perforated zone. Logging equipment may be run through the first lower branch of the y-tool to the perforated zone, the logging equipment operable to provide saturation information on both the production zone and the perforated zone and to provide production information across the perforated zone. The pressure gauge may be located in a production zone and be operable to collect pressure information from the production zone.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
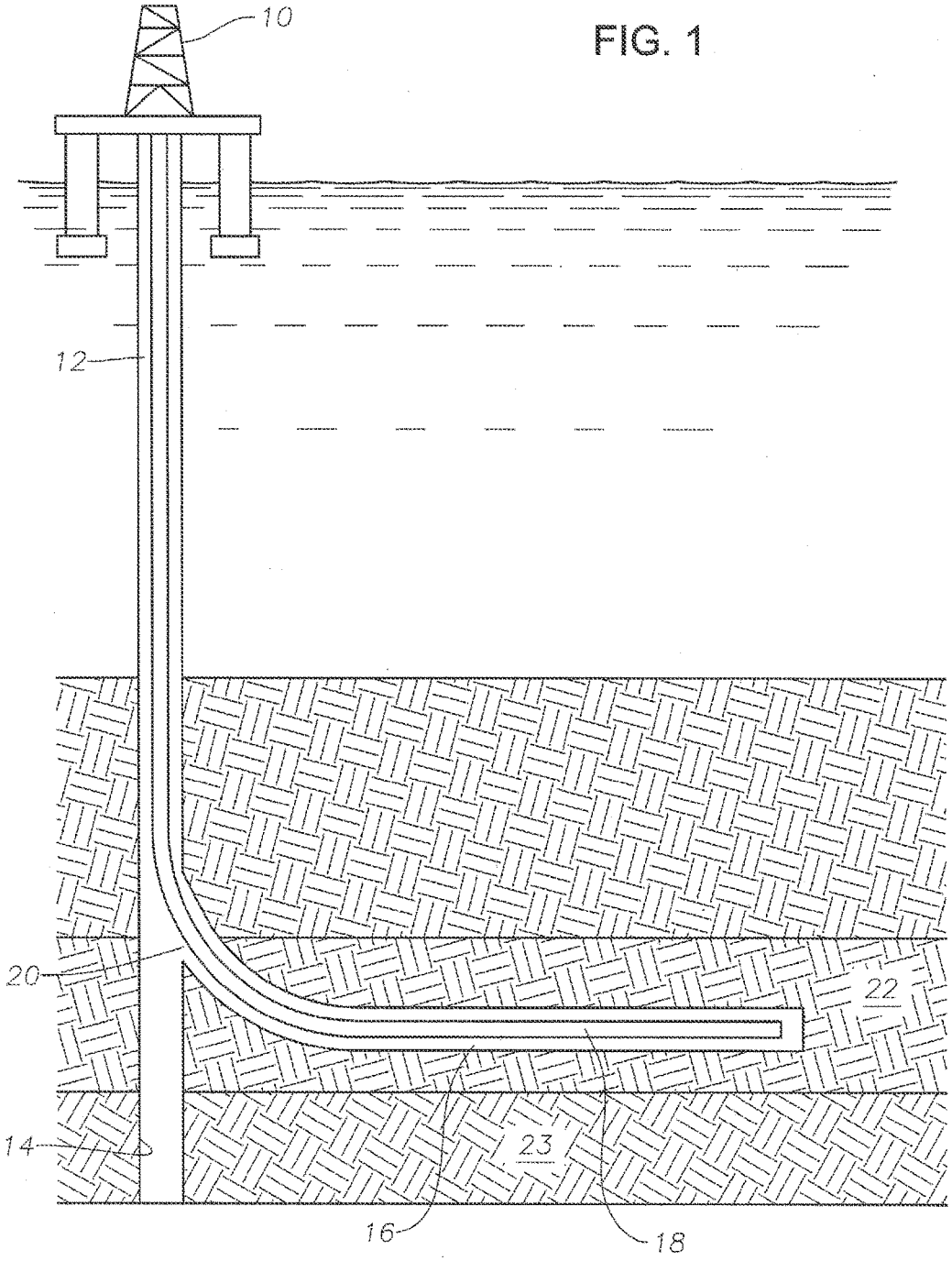
FIG. 1 is a schematic drawings of a hydrocarbon production system utilizing embodiments of the present application.

Looking at FIG. 1, an offshore hydrocarbon production system may include a surface platform 10 located at the surface of the water. Alternatively, the platform could be situated on land. A single slot can be used to drill a well 12, which includes a vertical well section 14 and a horizontal well section 16 which meet at junction 20. The horizontal well section 16 is located within the target production zone 22 and will allow for hydrocarbons within production zone 22 to be produced along flow path 18. Horizontal well section 16 may be, for example, a lateral well section. Vertical well section 14 passes through production zone 22 and into a lower zone 23. Vertical well section 14 can be used to observe conditions both in production zone 22 and the lower zone 23, which is an observation zone.

A vertical well section 14 for observation is drilled, cased and cemented. A whipstock is installed under the point in vertical well section 14 where junction 20 forms to guide the drilling of the horizontal well section 16. The horizontal well section 16 will then be sidetracked through a casing sidetrack window 52 to the production zone 22 away from the vertical well section 14. The horizontal well section 16 will be cased and cemented. Alternatively, other known means can be used to drill horizontal well section 16 of the well 12.

Figure 2:
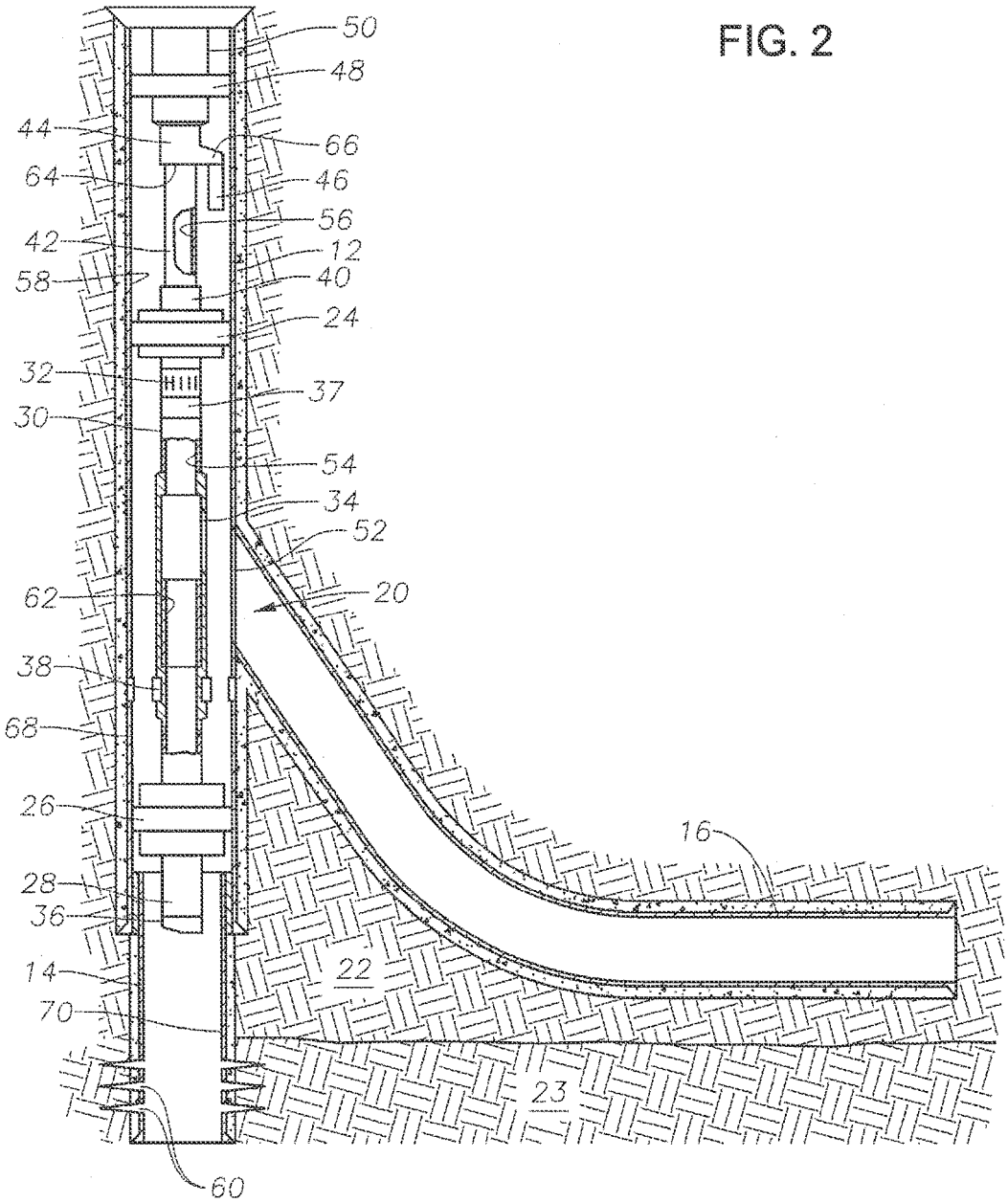
FIG. 2 is a partial sectional view of an embodiment of the apparatus of the present application.

Turning to FIG. 2, the junction 20 will be isolated with straddle packers 24, 26. Upper straddle packer 24 may be, for example, a standard industry seal bore packer. Lower straddle packer 26 may be, for example, a standard industry packer with a tail pipe 28. Tail pipe 28 extends from the bottom of lower straddle packer 26 to the production zone 22 and has a central bore which may be open to the fluids in vertical well section 14. Tail pipe 28 may also have a valve or other means for creating a barrier between its internal bore and the fluids in vertical well section 14. At the lower end of tail pipe 28 is operation gage 36. Operation gauge 36 may be capable of collecting data from the well 12, including pressure. Communications and power for operation gauge 36 may be provided by wires running from operation gauge 36 to the surface or by other means known in the industry. Perforations 60 will be made into the lower zone 23 in the vertical well section 14 below the bottom of tail pipe 28. Perforations 60 may be situated in a liner 70 installed below the bottom of casing 68 of vertical well section 14.

Between straddle packers 24, 26 there may be a tubing 30 with bore 54 for transporting production fluids to the surface. Tubing 30 may comprise sliding sleeve opening 32 which may be opened and closed by an operator and may be, for example, a sliding side door. Sliding sleeve opening 32, when open, will allow fluids from horizontal well section 16 to enter bore 54 of tubing 30. When closed, sliding sleeve opening 32 will not allow fluids to enter bore 54 of tubing 30.

Tubing 30 may also include a nipple profile 37 located below sliding sleeve opening 32 and above tubing sidetrack window 34. Nipple profile 37 can be used to prevent cross flow and isolate the well below the level of the nipple profile 37. Therefore any fluid entering tubing 30 from vertical well section 14 or horizontal well section 16 below the nipple profile 37 can be blocked from progressing further up tubing 30 and only the fluids that enter tubing 30 through sliding sleeve opening 32 will reach the surface.

Tubing 30 will also comprise tubing sidetrack window 34 on the same side of tubing 30 as the junction 20 between the horizontal well section 16 and the vertical well section 14. Tubing sidetrack window 34 will be in close proximity to casing sidetrack window 52 and will be used for access to horizontal well 16, if needed for intervention. A latch profile 38 located above lower straddle packer 26 ensures that the rotational orientation of the components of tubing 30 are correct so that tubing sidetrack window 34 is aligned with casing sidetrack window 52. In some embodiments, tubing sidetrack window 34 may include a means for opening or closing access to the window such as a window sliding sleeve 62.

Above upper straddle packer 24 may be a seal assembly 40 and tubing 42. Tubing 42 is connected to a first lower branch 64 of a y-tool 44 and has bore 56 which is in fluid communication with bore 54 of tubing 30. Second lower branch 66 of y-tool 44 is connected to an electrical submersible pump ("ESP") 46. An ESP packer 48 is located above y-tool 44 and a production line 50, which is in fluid communication with the upper end of y-tool 44 is located above ESP packer 48. Tubing 42 may be pre-perforated to allow fluid communication between bore 56 of tubing 42 and well bore 58 in the region above upper straddle packer 24 and below ESP packer 48.

In operation gauge 36 will provide representative and continuous pressure and saturation measurements without hindering production from the horizontal well section 16. In the case of a malfunction of operation gauge 36, the components can be removed and operation gauge 36 can be repaired, recalibrated or replaced. The ESP will provide lift to assist with the production of fluids from horizontal well section 16 and in addition, will provide pressure measurements from the horizontal well section 16. During normal production operations, the sliding sleeve opening 32 will be open to allow produced fluids from horizontal well section 16 to enter bore 54 of tubing 30. The produced fluids will continue upwards and into bore 56 of tubing 42 then into production line 50 to the surface. Nipple profile 37, which creates an internal barrier within bore 54 of tubing 30, will ensure that fluids in bore 54 of tubing 30 below the nipple profile 37 will not be able to reach tubing 42. Window sliding sleeve 62 may also be closed to ensure any fluids entering tubing 30 through tail pipe 28 from vertical well section 14 does not exit into horizontal well section 16 and mix with the produced fluids. Alternatively, a valve or other isolation means in tail pipe 28 may be closed so that no fluids from vertical well section 14 enter tubing 30.

If the horizontal well section 16 requires intervention, such as stimulation or to PLT the horizontal well section 16, it will be possible to access horizontal well 16 through tubing sidetrack window 34 using coiled tubing. Coiled tubing can be lowered through an internal bore of production line 50, and through ESP packer 48 and into first lower branch 64 of y-tool 44, thereby bypassing ESP 46. The coiled tubing will then continue through upper straddle packer 24 and into bore 54 of tubing 30.

The coiled tubing will be fed through nipple profile 37. Window sliding sleeve 62 will be opened. The lower end of a coiled tubing can be curved such that it can enter the tubing sidetrack window 34, pass through the casing sidetrack window 52 and enter horizontal well section 16. Intervention of horizontal well section 16 can therefore be accomplished without the need to pull any tubing and without bringing in a rig for any completion or de-completion operations.

When saturation or production logs are needed, the well 12 will be temporarily shut-in, and the sliding sleeve opening 32 will be closed and the window sliding sleeve 62 may also be closed. The logging equipment can be lowered through an internal bore of production line 50, through ESP packer 48 and into the first lower branch 64 of y-tool 44, thereby bypassing ESP 46. The logging equipment will then continue through upper straddle packer 24 and into bore 54 of tubing 30. The logging equipment will be fed through nipple profile 37 and downward through lower straddle packer 26, out the open end of tail pipe 28 and past the perforations 60 of vertical well section 14.

In this way, it will be possible to evaluate all zones for saturation, including production zone 22, and lower zone 23. The lower zone 23 with perforations 60 may also be logged for a production profile.

Figure 3:
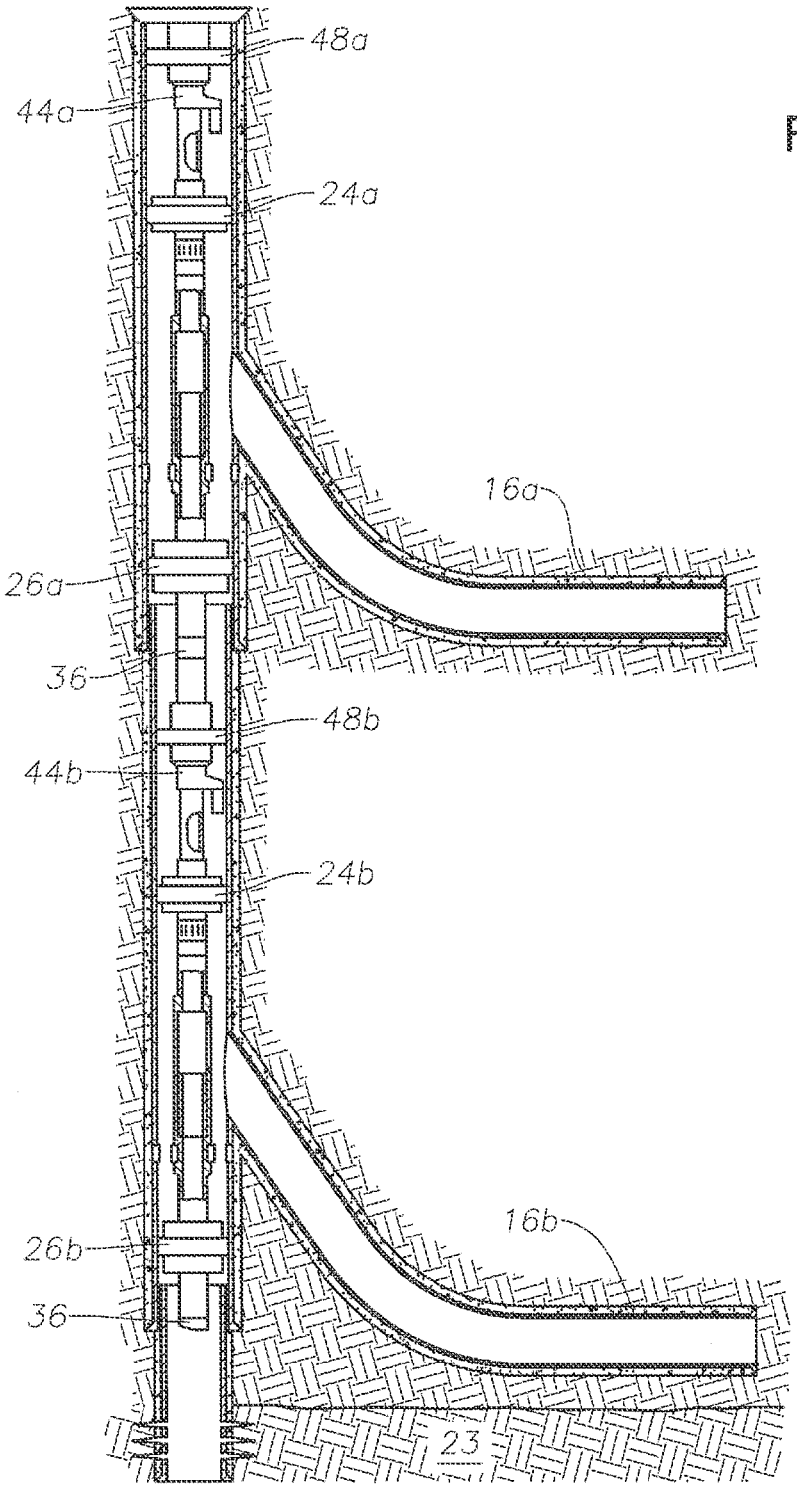
FIG. 3 is a partial sectional view of an alternate embodiment of the apparatus of the present application.

As shown in FIG. 3, in alternative embodiments, well 12 may comprise multiple horizontal wells 16*a*, 16*b*, each with a set of straddle packers 24*a*, 26*a*, 24*b*, 26*b*, an ESP packer 48*a*, 48*b*, and a y-tool 44*a*, 44*b*, for performing as described above. Observations may take place for a single or for multiple zones or reservoirs. Although well section 16 has been described as a horizontal well, the embodiments of the present application will apply equally to other lateral well configurations.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise. Optional or optionally means that the subsequently described event or circumstances may or may not occur. The description includes instances where the event or circumstance occurs and instances where it does not occur. Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these reference contradict the statements made herein.

That claimed is:

1. A method for producing hydrocarbons in a subterranean well useful for observing properties of one or more subterranean zones, the subterranean well having a vertical well section a plurality of lateral well sections, the intersection of the vertical well section and each of the plurality of lateral well sections creating a plurality of junctions, the method comprising the steps of:

(a) installing a lower straddle packer in the vertical well section below each of the plurality of junctions;

(b) installing an upper straddle packer in the vertical well section above each of the plurality of junctions to create an isolation zone between the lower straddle packer and the upper straddle packer around each of the plurality junctions;

(c) conveying hydrocarbons from the lateral well sections to the surface with a tubing;

(d) observing pressure information in at least one measurement zone with a pressure gauge located in the vertical well section outside all of the isolation zones, so that the pressure gauge does not hinder production from the lateral well section; and (e) obtaining information in at least one zone with a logging equipment run through the tubing.

2. The method of claim 1, further comprising the step of installing a sidetrack window in the tubing between the lower straddle packer and the upper straddle packer of each of the plurality of junctions for providing access to the lateral well sections, the tubing sidetrack window having a sliding means for opening and closing access to the tubing sidetrack window.

3. The method of claim 2, further comprising the steps of:

opening the sliding means of the tubing sidetrack window;

running coiled tubing from the surface down the tubing, through the tubing sidetrack window and into at least one of the lateral well sections; and performing an intervention procedure on the at least one of the lateral well sections.

4. The method of claim 1, wherein step (c) further comprises:

providing a sliding sleeve opening in the tubing below the upper straddle packer; and opening the sliding sleeve opening to allow fluids from at least one of the lateral well sections to enter the tubing.

5. The method of claim 1, further comprising the step of installing an isolation means below the upper straddle packer to prevent fluids below the isolation means within the tubing from flowing towards the surface.

6. The method of claim 1, further comprising the steps of:

installing a y-tool above the upper straddle packer;

connecting the tubing to a first lower branch of the y-tool;

connecting an electrical submersible pump to a second lower branch of the y-tool; and operating the electrical submersible pump to assist with the production of fluids from at least one of the lateral well sections.

7. The method of claim 6, wherein step (e) further comprises running the logging equipment through the first lower branch of the y-tool to bypass the electrical submersible pump.

8. The method of claim 6, further comprising the steps of:

providing a sidetrack window in the tubing between the lower straddle packer and the upper straddle packer;

opening the tubing sidetrack window;

running coiled tubing from the surface down the tubing, through the first lower branch of the y-tool, through tubing sidetrack window and into the at least one of the lateral well sections; and performing an intervention procedure on the at least one of the lateral well sections.

9. The method of claim 1, wherein the at least one measurement zone comprises a production zone and an observation zone and the method further comprises perforating the vertical well section below the lower straddle packer of at least one of the isolation zones at the level of the observation zone.

10. The method of claim 9, wherein step (d) comprises observing pressure information with the gauge in the production zone.

11. The method of claim 9, wherein step (e) comprises obtaining saturation information in both the production and observation zones.

12. The method of claim 9, wherein step (e) obtaining production logs in the observation zone.

13. An apparatus for producing hydrocarbons from a subterranean well while observing properties of one or more subterranean zones, the subterranean well having a vertical well section and a plurality of lateral well sections, the intersection of the vertical well section and each of the lateral well sections creating one or more junctions, the apparatus comprising:

an upper straddle packer located in the vertical well section above each of the plurality of junctions;

a lower straddle packer located in the vertical well section below each of the plurality of junctions to create an isolation zone between the upper straddle packer and the lower straddle packer around each of the plurality of junctions;

a pressure gauge located in a vertical well section outside all of the isolation zones, so that the pressure gauge does not hinder production from the one or more lateral well sections;

a tubing located in the vertical well for conveying hydrocarbons from at least one of the lateral well sections to the surface and for running tools from the surface through the upper straddle packer; and a means located within at least one of the isolation zones for isolating fluids in the vertical well section below the lower straddle packer from fluids in the at least one of the lateral well sections associated with the at least one of the isolation zones, and for providing access to both the at least one of the lateral well sections and the vertical well-section.

14. The apparatus of claim 13, further comprising a sidetrack window in the tubing between at least one of the isolation zones for providing access to at least one of the lateral well sections, the tubing sidetrack window having a sliding means for opening and closing access to the sidetrack window.

15. The apparatus of claim 13, further comprising a sliding sleeve opening in the tubing below the upper straddle packer, operable such that when the sliding sleeve opening is opened, fluids from the associated lateral well section may enter the tubing and flow to the surface.

16. The apparatus of claim 15, further wherein the isolation means is a nipple profile located below the sliding sleeve opening.

17. The apparatus of claim 13, further comprising:

a y-tool located above the upper straddle packer, the tubing being connected to a first lower branch of the y-tool; and an electrical submersible pump connected to a second lower branch of the y-tool to assist with the production of fluids from at least one of the lateral well sections.

18. The apparatus of claim 17, wherein the well includes a perforated zone outside the isolation zones, and wherein at least one of the lateral well sections is located in a production zone which is separate from the perforated zone, the apparatus further comprising logging equipment run through the first lower branch of the y-tool to the perforated zone, the logging equipment operable to provide saturation information on both the production zone and the perforated zone and to provide production information across the perforated zone.

19. The apparatus of claim 13 wherein the pressure gauge is located in a production zone and is operable to collect pressure information from the production zone.

* * * * *